US006776095B2

(12) United States Patent
Telser et al.

(10) Patent No.: US 6,776,095 B2
(45) Date of Patent: Aug. 17, 2004

(54) METHOD FOR LASER ENGRAVING FLEXOGRAPHIC PRINTING FORMS, AND PRINTING FORMS OBTAINED THEREBY

(75) Inventors: Thomas Telser, Weinheim (DE); Margit Hiller, Karlstadt (DE); Jens Schadebrodt, Mainz (DE); Jürgen Kaczun, Niederkirchen (DE)

(73) Assignee: BASF Drucksysteme GmbH, Stuttgart (DE)

( * ) Notice: Subject to any disclaimer, the term of this patent is extended or adjusted under 35 U.S.C. 154(b) by 0 days.

(21) Appl. No.: 10/297,208

(22) PCT Filed: Dec. 18, 2001

(86) PCT No.: PCT/EP01/14915

§ 371 (c)(1),
(2), (4) Date: Dec. 4, 2002

(87) PCT Pub. No.: WO02/49842

PCT Pub. Date: Jun. 27, 2002

(65) Prior Publication Data

US 2003/0136285 A1 Jul. 24, 2003

(51) Int. Cl.[7] ..... B41C 1/05

(52) U.S. Cl. ..... 101/401.1; 101/395; 101/401; 430/306; 430/327

(58) Field of Search ..... 101/395, 401, 101/401.1; 430/306, 307, 327, 328, 330, 331

(56) References Cited

U.S. PATENT DOCUMENTS

| | | | | | |
|---|---|---|---|---|---|
| 3,859,091 | A | * | 1/1975 | Wessells et al. | 430/306 |
| 4,528,909 | A | * | 7/1985 | Rigg et al. | 101/395 |
| 4,806,506 | A | * | 2/1989 | Gibson, Jr. | 430/309 |
| 4,857,437 | A | * | 8/1989 | Banks et al. | 430/327 |
| 5,259,311 | A | | 11/1993 | McCaughey, Jr. | 101/401 |
| 5,798,202 | A | | 8/1998 | Cushner et al. | 430/306 |
| 5,804,353 | A | | 9/1998 | Cushner et al. | 430/306 |
| 6,150,076 | A | * | 11/2000 | Yamamoto et al. | 430/327 |

FOREIGN PATENT DOCUMENTS

| | | |
|---|---|---|
| DE | 199 18 363 | 10/2000 |
| EP | 0 640 043 | 3/1995 |
| WO | WO 93/23252 | 11/1993 |
| WO | WO 93/23253 | 11/1993 |

* cited by examiner

*Primary Examiner*—Stephen R. Funk
(74) *Attorney, Agent, or Firm*—Keil & Weinkauf

(57) ABSTRACT

A process for the production of flexographic printing plates by laser engraving, in which the recording layer of a crosslinkable, laser-engravable flexographic printing element is crosslinked by the combination of a full-area crosslinking step with a crosslinking step which only acts at the surface, and a printing relief is engraved into the crosslinked recording layer by means of a laser, and flexographic printing plates obtainable by the process.

10 Claims, No Drawings

METHOD FOR LASER ENGRAVING FLEXOGRAPHIC PRINTING FORMS, AND PRINTING FORMS OBTAINED THEREBY

The present invention relates to a process for the production of flexographic printing plates by laser engraving in which the recording layer of a crosslinkable, laser-engravable flexographic printing element is crosslinked by the combination of a full-area crosslinking step with a crosslinking step acting only at the surface, and a printing relief is engraved into the crosslinked recording layer by means of a laser. The present invention furthermore relates to flexographic printing plates which can be produced by the process.

TECHNICAL FIELD

In the technique of laser direct engraving for the production of relief printing plates, for example flexographic printing plates, a relief which is suitable for printing is engraved directly into a relief layer which is suitable for this purpose. With the appearance of improved laser systems, this technique is increasingly also attracting commercial interest.

BACKGROUND OF THE INVENTION

For the production of flexographic printing plates by laser engraving, it is in principle possible to employ commercially available photopolymerizable flexographic printing elements. U.S. Pat. No. 5,259,311 discloses a process in which, in a first step, the flexographic printing element is photochemically crosslinked by full-area irradiation and, in a second step, a printing relief is engraved by means of a laser.

EP-A 640 043 and EP-A 640 044 disclose single-layer or multilayer elastomeric laser-engravable recording elements for the production of flexographic printing plates. The elements consist of "reinforced" elastomeric layers. For the production of the layer, use is made of elastomeric binders, in particular thermoplastic elastomers, for example SBS, SIS or SEBS block copolymers. In addition, the layer may comprise IR radiation-absorbent, generally strongly colored substances. The so-called reinforcement increases the mechanical strength of the layer. The reinforcement is achieved either by means of fillers, photochemical or thermochemical crosslinking, or combinations thereof.

EP-B 640 043 also discloses, on page 8, lines 52–59, various techniques for removing surface tackiness of reinforced laser-engravable flexographic printing elements, including exposure to UV-C light or treatment with bromine or chlorine solutions. The irradiation can be carried out before or after the laser engraving of the printing relief. As shown in the cited specification, treatment of this type for removing surface tackiness does not, however, represent further photochemical or thermochemical crosslinking of the relief layer.

The relief layers of laser-engravable flexographic printing elements should in the ideal case not melt during the laser engraving, but instead a direct transition of the degradation products into the gas phase should if possible take place. Melting of the layer may result in formation of melt borders around the printing elements, and the edges of the relief elements become less sharp. Flexographic printing plates having irregularities of this type give prints of worse quality than with printing plates without such defects.

The comparatively soft relief layers of flexographic printing plates, in particular those having thermoplastic elastomers as binders, tend to form melt borders during laser engraving.

Although this problem can generally be at least greatly reduced and in some cases even avoided by using very large amounts of IR absorbers, such as carbon black, in the order of from 30 to 50% by weight of all constituents of the layer, excessively high contents of IR absorber are, however, disadvantageous since the laser-engravable layer should not only be as sensitive as possible to laser radiation, but must also achieve the mechanical and printing performance features of conventionally produced flexographic printing plates. Excessively high absorber contents result, for example, in an impairment in important properties, such as elasticity, flexibility, cliche hardness and ink transfer behavior of the finished flexographic printing plate. In addition, the edges of the relief elements tend to fray if the IR absorber contents are too high.

Furthermore, it is in certain cases also extremely attractive to omit the addition of IR absorbers completely. Although the sensitivity of conventional thermoplastic-elastomeric binders to the radiation of Nd:YAG lasers is poor, the sensitivity to $CO_2$ is at least sufficiently good that commercially available photopolymeric flexographic printing elements that have been exposed to actinic light over the entire area can in principle be engraved by means of $CO_2$ lasers even without the need to add additional IR absorbers, as disclosed, for example, in U.S. Pat. No. 5,259,311. Although the engraving rate by $CO_2$ lasers is not always ideal without additional absorbers, the omission of strongly colored absorbers has the advantage that laser-engravable flexographic printing elements can be produced in the conventional manner by photopolymerization, and the person skilled in the art can continue to utilize his entire knowledge on the formulation of photopolymerizable recording layers for flexographic printing, the structure-property relationships and production technology.

SUMMARY OF THE INVENTION

It is an object of the present invention to provide a process for the production of flexographic printing plates by laser engraving by means of which the occurrence of melt borders can be prevented in a simple and straightforward manner without mechanical or printing performance features being impaired compared with those of conventional flexographic printing plates. In particular, it should be possible to use the process for transparent flexographic printing elements which contain no colored absorbers for laser radiation.

We have found that this object is achieved by a process for the production of flexographic printing plates by laser engraving in which the recording layer of a laser-engravable flexographic printing element is crosslinked by the combination of a full-area crosslinking step with a crosslinking step acting only at the surface, and a printing relief is engraved into the crosslinked recording layer by means of a laser. In a further aspect, we have found flexographic printing plates which can be produced by the process.

In a particular embodiment of the process according to the invention, the crosslinking step acting only on the surface is carried out through the action of UV-C radiation according to certain boundary conditions.

Surprisingly, it has been found that the novel combination of two different crosslinking steps significantly improves the quality of the resultant print relief compared with a printing relief which has been crosslinked only once. In particular, melt borders which impair the print appearance are almost completely prevented without the mechanical properties of the print relief, such as hardness, flexibility or rebound resilience, being impaired. This effect is evident in a particularly positive manner in the case of flexographic printing elements without absorbers for laser radiation.

The following details apply to the invention:

The term "laser-engravable" is taken to mean that the relief layer has the property of absorbing laser radiation, in particular the radiation from an IR laser, so that it is removed or at least delaminated at the points at which it is exposed to a laser beam of sufficient intensity. The layer is preferably evaporated or decomposed thermally or oxidatively in advance without melting, so that its decomposition products in the form of hot gases, vapors, fumes or small particles, can be removed from the layer.

Examples of suitable dimensionally stable supports for the crosslinkable, laser-engravable flexographic printing element employed as starting material are plates, films and conical and cylindrical tubes (sleeves) made from metals such as steel, aluminum, copper or nickel or plastics, such as polyethylene terephthalate (PET), polyethylene naphthalate (PEN), polybutylene terephthalate, polyamide, polycarbonate, optionally also woven and nonwoven fabrics, such as woven glass fiber fabrics, and composite materials, for example made from glass fibers and plastics. Suitable dimensionally stable supports are in particular dimensionally stable support films, such as polyester films, in particular PET or PEN films.

Of particular advantage are flexible metallic supports. For the purposes of the present invention, the term "flexible" is taken to mean that the supports are sufficiently thin that they can be bent around the printing cylinder. On the other hand, however, they are also dimensionally stable and sufficiently thick that the support is not kinked during production of the laser-engravable element or during mounting of the finished printing plate on the printing cylinder.

Suitable flexible metallic supports are in particular thin sheets or foils made from steel, preferably stainless steel, magnetizable spring steel, aluminum, zinc, magnesium, nickel, chromium or copper, it also being possible for the metals to be alloyed. It is also possible to employ combined metallic supports, for example steel sheets coated with tin, zinc, chromium, aluminum, nickel or also combinations of various metals, or also metal supports obtained by lamination of identical or different metal sheets. It is furthermore also possible to employ pretreated sheets, for example phosphated or chromatized steel sheets or anodized aluminum sheets. In general, the sheets or foils are degreased before use. Preference is given to sheets made from steel or aluminum. Particular preference is given to magnetizable spring steel.

The thickness of flexible metal supports of this type is usually from 0.025 mm to 0.4 mm and depends, besides on the desired degree of flexibility, also on the type of metal employed. Supports made from steel usually have a thickness of from 0.025 to 0.25 mm, in particular from 0.14 to 0.24 mm. Supports made from aluminum usually have a thickness of from 0.25 to 0.4 mm.

The starting material for the process furthermore comprises at least one crosslinkable, laser-engravable recording layer, which is applied to the support either directly or optionally via further layers. The crosslinkable recording layer comprises at least one binder. It may comprise further components for supporting the crosslinking, for example polymerizable monomers or oligomers, and/or compounds which are able to initiate the crosslinking reaction, for example initiators.

The recording layer can be crosslinked by high-energy radiation and/or thermally. Crosslinking by high-energy radiation can be carried out, in particular, photochemically by means of short-wave visible or long-wave ultraviolet light. However, radiation of higher energy, such as short-wave UV light or X-rays, an electron beam or—given suitable sensitization—also longer-wave light is of course in principle also suitable. Thermal crosslinking is carried out, in particular, by warming, but can in principle also be carried out at room temperature.

Particularly suitable binders for the layer are elastomeric binders. However, it is in principle also possible to employ non-elastomeric binders. The crucial factor is ultimately that the crosslinkable recording layer has elastomeric properties after crosslinking step (a) has been carried out. The recording layer may, for example, take on elastomeric properties through the addition of plasticizers, or it is also possible to employ crosslinkable oligomers, which only form an elastomeric network through reaction with one another.

Suitable elastomeric binders for the laser-engravable layer are, in particular, polymers which comprise 1,3-diene monomers, such as isoprene or butadiene. Examples which may be mentioned are natural rubber, polyisoprene, styrene-butadiene rubber, nitrile-butadiene rubber, butyl rubber, styrene-isoprene rubber, polynorbornene rubber or ethylene-propylene-diene rubber (EPDM). However, it is also in principle possible to employ ethylene-propylene, ethylene-acrylate, ethylene-vinyl acetate or acrylate rubbers. Also suitable are hydrogenated rubbers or elastomeric polyurethanes.

It is also possible to employ modified binders in which crosslinkable groups are introduced into the polymeric molecule by grafting reactions.

Particularly suitable elastomeric binders are thermoplastic elastomeric block copolymers comprising alkenylaromatic compounds and 1,3-dienes. The block copolymers can be either linear block copolymers or free-radical block copolymers. They are usually three-block copolymers of the A-B-A type, but can also be two-block copolymers of the A-B type, or those comprising a plurality of alternating elastomeric and thermoplastic blocks, for example A-B-A-B-A. It is also possible to employ mixtures of two or more different block copolymers. Commercially available three-block copolymers frequently comprise certain proportions of two-block copolymers. The diene units may be 1,2- or 1,4-linked. They may also be fully or partially hydrogenated. It is possible to employ both block copolymers of the styrene-butadiene and of the styrene-isoprene type. They are commercially available, for example under the name KRATON®. It is furthermore possible to employ thermoplastic-elastomeric block copolymers having end blocks of styrene and a random styrene-butadiene central block which are commercially available under the name STYROFLEX®.

The type and amount of binder employed are selected by the person skilled in the art depending on the desired properties of the printing relief of the flexographic printing element. In general, an amount of from 50 to 95% by weight of binder, based on the amount of all constituents of the laser-engravable layer, has proven successful. It is also possible to employ mixtures of different binders.

The crosslinkable, laser-engravable layer has crosslinkable groups which are able to form polymeric networks thermally, photochemically or under the action of high-energy radiation, either directly or by means of suitable initiators. Crosslinkable groups may be constituents of the elastomeric binder itself. The crosslinkable groups can be in the main chain, or can be terminal groups and/or pendant groups. It is of course possible for an elastomeric binder to have crosslinkable groups both as side groups and terminally or in the main chain.

It is furthermore possible to add monomeric or oligomeric compounds, each having crosslinkable groups, to the laser-engravable recording layer.

The number and type of the further components for crosslinking of the layer depends on the desired crosslinking method and are selected correspondingly by the person skilled in the art.

In the case of photochemical crosslinking, the recording layer comprises at least one photoinitiator or a photoinitiator system. Suitable initiators for the photopolymerization are, in a known manner, benzoin or benzoin derivatives, such as α-methylbenzoin or benzoin ethers, benzil derivatives, for example benzil ketals, acylarylphosphine oxides, acylarylphosphinic acid esters, and polycyclic quinones, without the list being restricted thereto. Preference is given to photoinitiators which have high absorption between 300 and 450 nm.

If the polymeric binder has crosslinkable groups to a sufficient extent, the addition of additional crosslinkable monomers or oligomers is unnecessary. In general, however, further polymerizable compounds or monomers are added for photochemical crosslinking. The monomers should be compatible with the binders and have at least one polymerizable, olefinically unsaturated group. Esters or amides of acrylic acid or methacrylic acid with monofunctional or polyfunctional alcohols, amines, aminoalcohols or hydroxyethers and -esters, styrene or substituted styrenes, esters of fumaric or maleic acid or allyl compounds have proven particularly advantageous. Examples of suitable monomers are butyl acrylate, 2-ethylhexyl acrylate, lauryl acrylate, 1,4-butanediol diacrylate, 1,6-hexanediol diacrylate, 1,6-hexanediol dimethacrylate, 1,9-nonanediol diacrylate, trimethylolpropane triacrylate, dioctyl fumarate and N-dodecylmaleimide. It is also possible to employ suitable oligomers having olefinic groups. It is of course also possible to employ mixtures of different monomers or oligomers, provided that these are compatible with one another. The total amount of any monomers employed is determined by the person skilled in the art depending on the desired properties of the recording layer. In general, however, 30% by weight, based on the amount of all constituents of the laser-engravable laser, should not be exceeded.

The thermal crosslinking can on the one hand be carried out analogously to the photochemical crosslinking using a thermal polymerization initiator instead of a photoinitiator. Polymerization initiators which can be employed are in principle commercially available thermal initiators for free-radical polymerization, for example suitable peroxides, hydroperoxides or azo compounds. As in photochemical crosslinking, additional monomers or oligomers can be employed, depending on the nature of the binder.

The thermal crosslinking may furthermore be carried out by adding a thermally curing resin, for example an epoxy resin, to the layer or by thermally crosslinking binders themselves containing sufficient amounts of polymerizable groups directly by means of suitable crosslinking agents.

The crosslinkable, laser-engravable flexographic printing element may furthermore comprise an absorber for laser radiation. It is also possible to employ mixtures of different absorbers for laser radiation. Suitable absorbers for laser radiation have high absorption in the region of the laser wavelength. In particular, suitable absorbers are those which have high absorption in the near infrared, and in the long-wave VIS region of the electromagnetic spectrum. Absorbers of this type are particularly suitable for the absorption of the radiation from Nd:YAG lasers (1064 nm) and from IR diode lasers, which typically have wavelengths of between 700 and 900 nm and between 1200 and 1600 nm.

Examples of suitable absorbers for the laser radiation are dyes which absorb strongly in the infrared spectral region, for example phthalocyanines, naphthalocyanines, cyanines, quinones, metal/complex dyes, for example dithiolenes, or photochromic dyes.

Other suitable absorbers are inorganic pigments, in particular intensely colored inorganic pigments, for example chromium oxides, iron oxides, carbon black or metallic particles.

Particularly suitable absorbers for laser radiation are finely divided carbon black grades having a particle size of from 10 to 50 nm.

The amount of optionally added absorber is selected by the person skilled in the art depending on the properties of the laser-engravable recording element that are desired in each case. In this connection, the person skilled in the art will take into account that the added absorbers influence not only the rate and efficiency of engraving of the elastomeric layer by laser, but also other properties of the relief printing element obtained as the end product from the process, for example its hardness, elasticity, thermal conductivity or ink transfer behavior. In general, it is therefore advisable to employ not more than a maximum of 20% by weight, preferably not more than 10% by weight and very particularly preferably not more than a maximum of 5% by weight of absorber for laser radiation. However, it is of course also possible to employ laser-engravable elements having higher contents of absorber in individual cases for the process.

In general, it is not advisable to add absorbers for laser radiation which also absorb in the UV region to recording layers which are to be photochemically crosslinked, since this greatly impairs the photopolymerization.

The laser-engravable layers according to the invention may furthermore also comprise additives and auxiliaries, for example dyes, dispersion aids, antistatics, plasticizers or abrasive particles. However, the amount of such additives should generally not exceed 10% by weight, based on the amount of all components of the crosslinkable, laser-engravable layer of the recording element.

The crosslinkable, laser-engravable recording layer may also be built up from a plurality of recording layers. These laser-engravable, crosslinkable sub-layers may have the same, approximately the same or different material compositions. A multilayer structure of this type, particularly a two-layer structure, is sometimes advantageous since it allows surface properties and layer properties to be modified independently of one another in order to achieve an optimum print result. For example, the laser-engravable recording element may have a thin laser-engravable upper layer whose composition has been selected with respect to optimum ink transfer, while the composition of the underlying layer has been selected with a view to optimum hardness or elasticity.

The thickness of the crosslinkable, laser-engravable recording layer or all recording layers together is generally from 0.1 to 7 mm. The thickness is selected suitably by the person skilled in the art depending on the desired application of the printing plate.

The crosslinkable, laser-engravable flexographic printing element employed as starting material may optionally comprise further layers.

Examples of such layers include an elastomeric underlayer of a different formulation which is located between the support and the laser-engravable layer(s) and need not necessarily be laser-engravable. Underlayers of this type allow the mechanical properties of the relief printing plates to be modified without affecting the properties of the actual printing relief layer.

MODE(s) FOR CARRYING OUT THE INVENTION

The same purpose is served by so-called elastic substructures, which are located below the dimensionally stable support of the laser-engravable recording element, i.e. on the opposite side to the laser-engravable layer. Elastic substructures or elastic underlayers may be crosslinkable and likewise crosslinked during crosslinking step (a). However, they may also already be crosslinked and be joined to the other layers, for example by lamination.

Further examples include adhesion layers, which bond the support to overlying layers or various layers.

Furthermore, the laser-engravable flexographic printing element may be protected against mechanical damage by a protective film, for example consisting of PET, which is located on the uppermost layer in each case, and which in each case must be removed before the laser engraving. In order to simplify removal, the protective film may also be siliconized or provided with a suitable release layer.

The laser-engravable flexographic printing element can be produced, for example, by dissolving or dispersing all components in a suitable solvent and casting the solution or dispersion onto a support. In the case of multilayer elements, a plurality of layers can be cast one on top of the other in a manner known in principle. Alternatively, the individual layers can be cast, for example, onto temporary supports, and the layers subsequently bonded to one another by lamination. Photochemically crosslinkable systems in particular can be produced by extrusion and/or calendering. This technique can in principle also be employed for thermally crosslinkable systems so long as use is only made of components which do not yet crosslink at the process temperature.

The crosslinkable, laser-engravable flexographic printing element employed as starting material is crosslinked over the entire area in the first process step (a) of the process according to the invention. This crosslinking step acts on the entire volume of the layer.

Depending on the type of crosslinking system selected, the recording element is to this end irradiated with high-energy radiation, for example with UV-A radiation or with electron beams, or the recording element is warmed. The irradiation or warming should be carried out as uniformly as possible in order to avoid as far as possible inhomogeneities in the degree of crosslinking of the layer. Uniform irradiation can also be achieved, for example, by irradiating the layer on the one hand from the upper side and in addition from the lower side through the dimensionally stable support. A prerequisite for this is of course that the support is transparent to the respective radiation. It is of course also possible for the two crosslinking methods to be combined with one another. Although homogeneity is desirable, the present invention does not exclude the crosslinking density having inhomogeneities. For example, the crosslinking density may have a gradient.

It is essential for the process according to the invention that not all groups in the layer which are crosslinkable in principle are reacted during said full-area crosslinking during process step (a) with formation of a polymeric network, but instead as yet unreacted, crosslinkable groups remain in the crosslinked recording layer.

This incomplete reaction can be achieved, for example, by selecting the irradiation time or the duration of the warming in such a way that the reaction is still incomplete when the warming or irradiation of the flexographic printing element is terminated. It can also be effected, for example, by restricting the amount of initiator, so that the latter is used up before complete conversion of crosslinkable groups is achieved.

The incomplete reaction can also be achieved by employing a laser-engravable flexographic printing element whose layer has crosslinkable groups of different reactivity, and selecting the reaction conditions in such a way that preferentially only one type of crosslinkable groups reacts during the crosslinking reaction, while the other type is not yet reacted. The recording layer may also have, for example, both thermally and photochemically crosslinkable groups and be only thermally or only photochemically crosslinked, so that groups of one type remain over.

The methods can of course also be combined with one another. The degree of reaction during the crosslinking is prescribed by the person skilled in the art depending on the desired properties of the crosslinked layer.

Crosslinking step (b) which only acts at the surface only affects parts of the laser-engravable layer. Further crosslinking does not take place throughout the laser-engravable layer, but instead only in a part-volume of the layer. The effectiveness of the crosslinking step (b) has a penetration depth which is limited when viewed from the surface of the laser-engravable recording layer, so that the uppermost zone of the laser-engravable layer is crosslinked to a greater extent than would be the case on exclusive use of process step (a). All or some of the crosslinkable groups which are not reacted in process step (a) are reacted here.

Process step (b) is preferably carried out after process step (a), but the two process steps can also be carried out simultaneously. In special cases, (b) can be carried out first, followed by (a).

The width of the zone within which the crosslinking density is raised by step (b) or the effective penetration depth of the measure taken for crosslinking is generally at least 5 $\mu$m and not greater than 200 $\mu$m, seen from the surface of the recording layer, without the width definitely being limited thereto. The penetration depth is preferably 5–150 $\mu$m and particularly preferably 5–100 $\mu$m.

If the starting materials employed for the process according to the invention are multilayer laser-engravable recording elements, it is also possible for a plurality of layers, depending on the respective thickness of the layer, to be affected by process step (b). It goes without saying that the crosslinking density of the recording layers of different composition may be different. The process according to the invention increases the crosslinking density in each of these layers—up to the maximum penetration depth—beyond the extent achieved in process step (a).

The transition from the zone whose crosslinking density is increased during step (b) beyond the extent from process step (a) to the zone which is no longer affected by process step (b) may be abrupt, comparatively steep or gradual. The penetration depth is defined using the inflexion point of the crosslinking density as a function of the penetration depth.

A plurality of methods are available to the person skilled in the art for carrying out process step (b). The choice of method is restricted only inasmuch as the method must not adversely affect other properties of the flexographic printing element.

For example, the flexographic printing element can be irradiated at the surface with high-energy radiation or warmed at the surface. The element can also be treated with polymerization initiators or crosslinking agents, optionally followed by irradiation or warming.

In the case of laser-engravable flexographic printing elements which also have photochemically crosslinkable groups, an embodiment which has proven particularly successful is one in which the crosslinked laser-engravable flexographic printing element is irradiated with UV light having a wavelength of from 200 nm to 300 nm, so-called UV-C light. The method is particularly suitable if the layer has olefinic double bonds as crosslinkable groups. Due to the comparatively strong scattering of the short-wave light in the layer, the intensity of UV-C radiation drops considerably with increasing penetration depth, so that only the uppermost zone of the flexographic printing element is effectively crosslinked.

The requisite exposure time depends on the power and arrangement of the UV-C light source and on the type of flexographic printing element, in particular on its content of IR absorbers. The irradiation with UV-C also results in the effect according to the invention in the case of more highly filled plates.

It should expressly be pointed out at this point that the surface crosslinking with UV-C light does not require that the layer must have been photochemically crosslinked in the preceding process step (a). It is also possible to employ thermally crosslinked recording elements, provided that they still have crosslinkable olefinic double bonds.

Crosslinking by means of UV-C light is possible without an additional photoinitiator. However, a particularly advantageous embodiment of the invention is to employ a laser-engravable recording element whose recording layer comprises a photoinitiator which is activated by light having a wavelength of from 200 to 300 nm. An initiator of this type is added to the laser-engravable layer during the production process and is converted into the layer together with all other components, or the layer is treated with the initiator just before step (b). In the case of multilayer recording elements, it is furthermore advantageous not to add said photoinitiator to all layers, but only to the uppermost layer(s).

Examples of suitable initiators which absorb in the UV-C region include aryl ketones of the general formula R—CO-aryl, where R is, in particular, alkyl groups, such as methyl, ethyl or propyl, or alternatively substituted alkyl groups, such as a benzyl group. The aryl radical may also be further substituted.

If process step (a) is carried out photochemically, the full-area crosslinking should generally not be carried out with UV-C light, although an embodiment of this type should not be excluded for special cases.

The additional crosslinking in the uppermost zone can also be carried out by surface warming of the layer, which causes thermally crosslinkable groups still present to crosslink further. The surface warming can be carried out, for example, by brief irradiation with IR radiation. Particularly suitable for this purpose are high-power heat radiators, with which the surface of the element can be warmed briefly, but strongly, for example by passing the recording elements slowly under an IR emitter on a conveyor belt. It is important that uniform warming of the element as a whole is avoided. The surface warming can also be carried out, for example, by treatment with microwaves. It is furthermore possible to add to the recording element an additional thermal polymerization initiator which only decomposes at the temperatures of the surface warming, but not at the production temperatures of the layer. In the case of multilayer flexographic printing elements, it is furthermore advantageous not to add said initiator to all layers, but only to the uppermost layer(s).

It is also possible not to add polymerization initiators to the laser-engravable recording layer, but instead to treat the surface of the laser-engravable flexographic printing element with a suitable polymerization initiator. The surface can, for example, be brought into contact with a solution of the initiator. Solvents can be employed here which slightly swell the surface of the recording element in order to facilitate penetration of the polymerization initiator. However, excessive swelling should be avoided since otherwise the printing properties of the finished flexographic printing plate could be impaired. Examples of polymerization initiators include thermally labile organic peroxides or peresters, for example those which are able to form t-butoxy, cumyloxy, methyl or phenyl radicals, hydrogen peroxide or inorganic peroxides. It is furthermore possible to employ thermally labile azo compounds, for example azobisisobutyronitrile or similar compounds. Further examples include halogens in pure or dissolved form, sulfur/halogen compounds or redox initiator systems.

For the dissolution or in order to complete the surface crosslinking, the laser-engravable flexographic printing element can, after the treatment with initiator, be irradiated at the surface or warmed at the surface, again as mentioned above.

In process step (c), a printing relief is engraved into the crosslinked, laser-engravable layer by means of a laser. It is advantageous to engrave image elements in which the edges of the pixels initially fall off vertically and only spread out in the lower region of the image element. This results in a good shoulder shape of the image dots, but nevertheless low dot gain. However, it is also possible to engrave image dot edges of a different shape.

Particularly suitable for laser engraving are $CO_2$ lasers having a wavelength of 10,640 nm, but also, depending on the material situation, Nd:YAG lasers (1064 nm) and IR diode lasers or solid-state lasers, which typically have wavelengths of from 700 to 900 nm and from 1200 to 1600 nm. However, it is also possible to employ lasers having shorter wavelengths, provided that the lasers have adequate intensity. For example, a frequency-doubled (532 nm) or frequency-tripled (355 nm) Nd:YAG laser or excimer lasers (for example 248 nm) can also be employed. The image information to be engraved is transferred directly from the layout computer system to the laser apparatus. The lasers can be operated either continuously or in pulsed mode.

In general, the flexographic printing plate obtained can be employed directly. If desired, however, the flexographic printing plate obtained can subsequently be cleaned. A cleaning step of this type removes layer constituents which have been detached, but have not yet been completely removed from the plate surface. In general, simple treatment with water or alcohols is entirely sufficient.

The process according to the invention can be carried out in a single production operation in which all process steps are carried out one after the other. However, the process can also advantageously be terminated after process step (b). The crosslinked, laser-engravable recording element can be packaged and stored and only converted further into a flexographic printing element by laser engraving at a later time. It is advantageous here to protect the flexographic printing element, for example using a temporary cover film, for example made of PET, which must of course be removed again before the laser engraving.

The advantages of the process according to the invention with two-stage crosslinking are evident from the flexographic printing plate obtained. Due to process step (b), the surface of the laser-engravable flexographic printing element is cured without thereby impairing the elastic properties of the layer. The layer crosslinked in this way can be engaged by lasers without causing melt borders by the engraving process.

EXAMPLES

The following examples are intended to explain the invention in greater detail:

Example 1

A commercially available flexographic printing element (type: NYLOFLEX® FAH, thickness 1.14 mm) was employed as starting material. The cover film was removed, and the substrate layer was washed with alcohol. The flexographic printing element was subsequently irradiated over the entire area with UVA light for 15 minutes. An incompletely crosslinked relief layer was obtained in which double bonds which had still not reacted were evident. The exposed plate was subsequently divided into five pieces of approximately equal size. One piece remained untreated for comparative purposes, a further piece was subjected to conventional detackification, and in three pieces, the surface of the element was crosslinked further as described below.

Example 2

A commercially available flexographic printing element (type: CYREL® NOW, thickness 1.14 mm DuPont) was employed as starting material. The cover film was removed, and the substrate layer was washed with alcohol. The flexographic printing element was subsequently irradiated over the entire area with UVA light for 15 minutes. An incompletely crosslinked relief layer was obtained in which double bonds which had still not reacted were evident. The exposed plate was subsequently divided into two pieces of approximately equal size. One piece remained untreated for comparative purposes, and in the other, the surface of the element was crosslinked linked further as described below.

Example 3

A photosensitive mixture was prepared from the following components: 124 g of KRATON® D-1102, 16 g of LITHENE® PH, 16 g of lauryl acrylate, 2.4 g of LUCIRIN® BDK and 1.6 g of KEROBIT® TBK. The components were dissolved in 240 g of toluene at 110° C. The homogeneous solution obtained was cooled to 70° C. and applied to a plurality of transparent PET films with the aid of a doctor blade in such a way that a homogeneous dry-layer thickness of 1.2 mm was obtained in each case. The layers produced in this way were firstly dried at 25° C. for 18 hours and finally at 50° C. for 3 hours. The dried layers were subsequently each laminated to an equally sized piece of a second PET film coated with adhesive lacquer. After a storage time of one day, the layers were exposed to UV/A for 5 minutes after the cover film had been removed. An incompletely crosslinked relief layer was obtained in which double bonds which had still not reacted were evident. The exposed plate subsequently divided into three pieces of approximately equal size. One piece remained untreated for comparative purposes, a further was subjected to conventional detackification, and in a further piece, the surface of the element was crosslinked further as described below.

Conventional Detackification with Bromine Solution

A solution (solution 1) was prepared from 11.7 g of potassium bromide, 3.3 g of potassium bromate and 85 g of water. The post-treatment solution (solution 2) was subsequently prepared from 10 g of solution 1, 500 g of water and 5 g of conc. HC1.

Solution 2 was introduced into a dish, to which the corresponding, UV/A-exposed plate piece was added (with no air bubbles). After immersion in solution 2 for 5 minutes on one side, the plate piece was rinsed with deionized water and dried. After measurement of the pendulum tack, the surface detackification of the plate was determined.

Additional Surface Crosslinking

Variant A: Crosslinking with Peroxide Solution 50 g of tert-butyl peroctanoate were dissolved in 450 g of toluene. This 10% peroxide solution was introduced into a dish. The respective UV/A-exposed plate piece was immersed on one side for a duration of 15 minutes (with no bubbles). The plates were removed, dried and subsequently crosslinked for 10 minutes at 160° C. in a drying cabinet.

Variant B: Crosslinking with Peroxide Solution 50 g of dicumyl peroxide were dissolved in 450 g [lacuna]. The 10% peroxide solution was applied to the surface of the UV/A exposed plate piece in question in a wet layer thickness of about 100 $\mu$m. After drying at room temperature for 24 hours, the layer was crosslinked for 10 minutes at 160° C. in a drying cabinet. The resultant plate was subsequently rinsed and dried.

Variant C: Crosslinking by UV/C

The UV/A-exposed plate piece in question was exposed to UV/C from the top for 20 minutes. The intensity was selected in such a way that the penetration depth of the UV/C radiation into the plate did not exceed 200 $\mu$m.

Engraving of the Plates

All plate pieces obtained (without and with further treatment) were engraved with a $CO_2$ laser (ALE, Meridian Finesse, 250 W, engraving speed=200 cm/s). A complete test motif comprising solid areas and various raster elements was engraved into the respective flexographic printing element. The quality of the flexographic printing plate obtained was assessed under the microscope. In particular, melt borders around negative elements were noted. The results are compiled in table 1.

TABLE 1

Compilation of the results

| No. | Flexographic printing element | Surface postcrosslinking | Engraving depth [$\mu$m] | Melt borders |
|---|---|---|---|---|
| Example 4 | Example 1 | A | 656 | little |
| Example 5 | Example 1 | B | 650 | little |
| Example 6 | Example 1 | C | 899 | none |
| Example 7 | Example 2 | C | 690 | little |

TABLE 1-continued

Compilation of the results

| No. | Flexographic printing element | Surface postcrosslinking | Engraving depth [μm] | Melt borders |
|---|---|---|---|---|
| Example 8 | Example 3 | C | 710 | little |
| Comparative example 1 | Example 1 | none | 650 | strong |
| Comparative example 2 | Example 1 | no conventional detackification | 886 | strong |
| Comparative example 3 | Example 2 | none | 690 | strong |
| Comparative example 4 | Example 3 | none | 710 | strong |
| Comparative example 5 | Example 3 | no conventional detackification | 750 | strong |

We claim:

1. A process for the production of flexographic printing plates by laser engraving, which comprises providing a crosslinkable, laser-engravable flexographic printing element as starting material, which element comprises at least, arranged one on top of the other, a dimensionally stable support, at least one crosslinkable, laser-engravable recording layer comprising at least one binder, and at least the following process steps:

(a) full-area crosslinking of the recording layer, wherein the crosslinking is conducted so that not all groups in the layer which are crosslinkable are reacted, to form a full-area crosslinked recording layer which contains unreacted, crosslinkable groups, (c) engraving of a print relief into the crosslinked recording layer by means of a laser, and further comprises an additional crosslinking step (b) which acts only at the surface of the recording layer and by means of which the recording layer, regarded from the surface, is further crosslinked to a penetration depth of from 5 to 200 μm beyond the extent of the crosslinking density effected by step (a), and wherein process step (a) is carried out first, followed by process step (b), or process steps (a) and (b) are carried out simultaneosly.

2. A process as claimed in claim 1, wherein process step (a) is carried out photochemically or thermally.

3. A process as claimed in claim 1, wherein the penetration depth to which crosslinking is additionally carried out in step (b) is from 5 to 150 μm.

4. A process as claimed in claim 1, wherein the surface crosslinking step (b) is carried out with UV light having a wavelength of from 200 to 300 nm.

5. A process as claimed in claim 1, wherein the surface crosslinking step (b) is carried out by warming the surface of the laser-engravable recording layer.

6. A process as claimed in claim 1, wherein the surface crosslinking step (b) is carried out by treating the surface of the laser-engravable layer with a polymerization initiator or a crosslinking reagent.

7. A process as claimed in claim 6, wherein the treated surface is irradiated or warmed at the surface in a further process step.

8. A flexographic printing plate obtainable by a process as claimed in claim 1.

9. A laser-engravable recording element for the production of flexographic printing plates obtainable by a process which comprises providing a crosslinkable, laser-engravable flexographic printing element which comprises at least, arranged one on top of the other, p1 a dimensionally stable support, and at least one crosslinkable, laser-engravable recording layer comprising at least one binder, and at least the following steps:

(a) full-area crosslinking of the recording layer, wherein the crosslinking is conducted so that not all groups in the layer which are crosslinkable are reacted, to form a full-area crosslinked recording layer which contains unreacted, crosslinkable groups, and (b) further crosslinking the surface of the recording layer so that the recording layer, regarded from the surface, is further crosslinked, beyond the extent of the crosslinking density effected by step (a), to a penetration depth of from 5 to 200 μm, and wherein process step (a) is carried out first, followed by process step (b), or process steps (a) and (b) are carried out simultaneously.

10. The laser-engravable recording element as claimed in claim 9, wherein the penetration depth to which crosslinking is additionally carried out in step (b) is from 5 to 150 μm.

* * * * *